US010391342B2

(12) United States Patent
Farley et al.

(10) Patent No.: US 10,391,342 B2
(45) Date of Patent: Aug. 27, 2019

(54) FIRE PROTECTION UNIT

(71) Applicant: Tyco Fire Products LP, Lansdale, PA (US)

(72) Inventors: Joseph D. Farley, Warwick, MA (US); Jeffrey Barkley, Cumberland, RI (US); Scott Going, Lubbock, TX (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 15/521,788

(22) PCT Filed: Nov. 9, 2015

(86) PCT No.: PCT/US2015/059792
§ 371 (c)(1),
(2) Date: Apr. 25, 2017

(87) PCT Pub. No.: WO2016/073994
PCT Pub. Date: May 12, 2016

(65) Prior Publication Data

US 2017/0232284 A1 Aug. 17, 2017

Related U.S. Application Data

(60) Provisional application No. 62/077,080, filed on Nov. 7, 2014.

(51) Int. Cl.

| | |
|---|---|
| ***A62C 35/13*** | (2006.01) |
| ***A62C 37/40*** | (2006.01) |
| ***A62C 3/00*** | (2006.01) |
| ***A62C 35/02*** | (2006.01) |

(52) U.S. Cl.
CPC ..... *A62C 35/13* (2013.01); *A62C 3/002* (2013.01); *A62C 3/006* (2013.01); *A62C 35/023* (2013.01); *A62C 37/40* (2013.01); *A62C 3/008* (2013.01)

(58) Field of Classification Search
CPC ..... A62C 35/13; A62C 3/002; A62C 3/006; A62C 35/023; A62C 37/40
USPC ..... 169/46
See application file for complete search history.

(56) References Cited

U.S. PATENT DOCUMENTS

| | | | | |
|---|---|---|---|---|
| 4,981,178 A * | 1/1991 | Bundy | ..... | A62C 5/02 169/13 |
| 5,697,450 A | 12/1997 | Stehling et al. | | |
| 7,163,642 B2 * | 1/2007 | Hagquist | ..... | A62C 2/065 169/44 |

(Continued)

FOREIGN PATENT DOCUMENTS

| | | |
|---|---|---|
| DE | 102010025054 | 12/2011 |
| WO | WO 2004080541 | 9/2004 |

OTHER PUBLICATIONS

International Search Report and Written Opinion, PCT/US2015/059792, dated Feb. 17, 2016, 14 pages.

(Continued)

*Primary Examiner* — Chee-Chong Lee
(74) *Attorney, Agent, or Firm* — Foley & Lardner LLP

(57) ABSTRACT

Systems and methods for fire protection of a fixed space using a fire protection unit having a fixed volume of fire-fighting agent; a manifold coupled to the fixed volume and an actuator axially aligned with the manifold to pressurize the firefighting agent within the manifold for discharge and dispersion to protect the fixed space.

14 Claims, 8 Drawing Sheets

(56) References Cited

U.S. PATENT DOCUMENTS

| | | | | |
|---|---|---|---|---|
| 2006/0219416 | A1* | 10/2006 | Fore | A62C 5/02 169/44 |
| 2008/0168798 | A1* | 7/2008 | Kotliar | A62C 3/0221 62/640 |
| 2009/0084561 | A1* | 4/2009 | Popp | A62C 3/08 169/60 |
| 2010/0025053 | A1* | 2/2010 | Chesley | A62C 3/16 169/56 |
| 2011/0108290 | A1 | 5/2011 | Feenstra | |
| 2012/0118592 | A1* | 5/2012 | Lowry | A62C 31/05 169/70 |
| 2012/0168184 | A1 | 7/2012 | Enk, Sr. | |
| 2012/0186835 | A1 | 7/2012 | Meier | |
| 2013/0000927 | A1 | 1/2013 | Meier et al. | |
| 2013/0098638 | A1 | 4/2013 | Dunster et al. | |
| 2014/0138107 | A1 | 5/2014 | Dyson, III | |

OTHER PUBLICATIONS

IFW, U.S. Appl. No. 62/077,080, filed Nov. 7, 2014, 59 pages; Apr. 25, 2017.

* cited by examiner

FIRE PROTECTION UNIT

PRIORITY DATA & INCORPORATION BY REFERENCE

This application is a 35 U.S.C. § 371 application of International Application No. PCT/US2015/059792 filed Nov. 9, 2015, which claims the benefit of priority to U.S. Provisional Patent Application No. 62/077,080, filed Nov. 7, 2014, each of which is incorporated by reference in its entirety.

TECHNICAL FIELD

The present invention relates generally to fire protection units or assemblies to implement, install, and/or build upon to provide fire protection systems and methods for addressing fires for fixed space fire protection.

BACKGROUND ART

Fire protection of any defined space, area, volume, room, or occupancy can present its own design challenges for fire protection system and equipment designers and/or manufacturers. Generally, the designer must consider how the space to be protected, including its physical location, its dimensions, its application or use, and/or the occupants or items within the space, can impact fire protection system design and/or performance. Depending upon the location of the space to be protected, fire protection system designs may be limited or constrained by the availability of electrical power and/or firefighting agents or fluids such as water. Spaces, such as for example, tunnels may be in locations, or have areas therein, in which it is difficult to supply water for firefighting or electricity for system components. Known solutions for installations having limited water may include self-contained, central supplies of firefighting agent or fluid, such as for example a centralized storage tank of water for use in a fixed deluge firefighting systems for road tunnels. Such a limited supply of firefighting fluid can raise other design issues or complexities for sufficient fire protection, such as for example, supply depletion due to application rates of the firefighting fluid and/or duration of system operation. Alternatively, if the protected space is located in an area where water and power are readily available, the space may be in an area where it is undesirable to have a large volume of water discharged or distributed to address a fire due to the potential for costly water damage. Accordingly the objective for the system designer may be to provide fire protection with a minimal amount of water.

The physical dimensions and/or configuration of the occupancy must also be considered in fire protection. For example, designers must consider the length, area, and/or volume over which a firefighting agent or fluid is to be dispersed, distributed or applied. If the space to be protected is relatively small, such as for example the space above a stove or fryer as compared to a storage warehouse, it may not be cost effective to install a complex piping system to deliver firefighting fluid to one or two devices, such as for example, nozzles.

The protected space may present possible obstructions to the firefighting fluid distribution and/or application. For example, storage warehouses or spaces can present challenges for owners, operators, designers and/or installers to provide the appropriate based spray type sprinkler systems for the warehoused items or its occupants from floor to ceiling. In storage warehouses protected by automatic sprinklers located at the ceiling above storage racks and commodities, designers are concerned with the application of water including both its distribution and penetration, to address storage fires with suppression or control, which may initiate at the floor of the occupancy and be obscured by the storage or the storage racks. Water distribution density requirements, system hydraulics, sprinkler spacing, and obstructions due to the commodity itself and/or the racks structures upon which the commodity is stored, can place design or operating constraints on the fire protection system and impact its performance. One known solution to address fire protection of rack storage systems is to employ "in-rack" sprinklers at regular height intervals throughout the storage rack system with water supply lines running along or parallel to the storage racks to provide water to the in-rack sprinklers. However, currently available in-rack sprinklers have their own disadvantages, which include: (1) installation and material costs, (2) loss of rack adjustment flexibility, (3) potential for damage due to freezing water supply pipes, and (4) excess water damage from sprinkler discharge.

Regardless of the type of space being protected, fire protection system designers must consider the application or use of the space and how people or equipment may operate in the space and impact, interfere or modify operation of the system and/or its components overtime. System designers may have to consider the durability and exposure of system components to impact forces during normal operations within the space. For example, warehouses in which forklifts, palletized commodities or other stored items are frequently moved about, designers, installers and maintenance personnel are concerned with minimizing damage to the components of the fire protection system and the fluid supply lines.

Additionally, depending upon the application or use of the protected occupancy, there may be a need to frequently change or expand the fire protection system. Thus, designers need to consider the ease in which a system can be maintained, altered and/or expanded. For example, standard spray type fire protection systems can be difficult to change or expand due to time and materials to alter or expand the fluid supply piping or the need to completely shut down the fire protection system to make the desired changes.

Effective and efficient fire protection can be difficult to achieve due to the shape and size of the materials, items or equipment being protected by the system. For example, one issue in the protection of boats stored dry in racks is that it can be difficult to efficiently apply water in the event of a fire. As an initial matter, the boats can be of varying size so it can be difficult to install protection devices uniformly to suit all storage situations. Moreover, due to the nature of a boat hull, there is the potential for discharged water to accumulate in the hulls of the boats, which can present an added hazard as the collected water can overload the storage racks. Furthermore, for other fire protection hazards, it may be desirable to avoid the discharge of water into the area due to the operative use of the area, such as, data rooms and records storage. Accordingly, for some applications it may be desirable to use a firefighting agent other than water. One known alternative includes the use of hypoxic air to reduce the ability for fires to start and/or continue to burn. The problems with this solution include: (a) the difficulty in maintaining an adequate envelope or sealing over the area of application to prevent the introduction of external oxygen which may reignite a fire; and (b) the health safety risk to workers due to a reduced oxygen environment.

DISCLOSURE OF INVENTION

It is desirable to have fire protection systems and methods which address the described design concerns and considerations. A preferred fire protection unit for independent installation, position and/or operation to address a fire is provided. Preferred embodiments of the unit can detect and address fires as independent units; or alternatively, the units can be interconnected and/or controlled for addressing a fire collectively. Accordingly, preferred fire protection systems and methods for the protection of a fixed space employing the preferred fire protection units are provided. As used herein, a "fixed space" is defined as a bound area or volume partially or completely enclosed, outlined or compartmentalized by a structure or formation. Accordingly, a fixed space includes, but is not limited to, warehouses; tunnels; equipment rooms; storage occupancies, storage bays, storage compartments, or portions thereof including storage compartments or racks; kitchens; concealed spaces attics, vents, ducts or portions thereof; land, air, or water vehicle storage facilities or portions thereof including garages, hangers, or dry dock boat rack storage facilities and/or air, land or water vehicle interiors or compartments including cargo vessels and their holding areas, boat or ship hulls, automobile interiors, aircraft cabins and any other fixed space in which the preferred units can be installed in a manner described herein.

Preferred embodiments of the unit include a discrete fixed volume of firefighting agent and provide for its independent discharge, distribution and/or dispersion for addressing and more preferably suppression of a fire in the protection of a fixed space. One preferred embodiment of a fire protection unit includes an actuator; a fixed volume supply of compressed gas coupled to the actuator for controlled release of the compressed gas; a fixed volume source of firefighting agent coupled to the supply of compressed gas; and a manifold coupled to the firefighting agent for dispersing the agent, the manifold defining a longitudinal axis, an internal passageway and a plurality of openings in fluid communication with the internal passageway and spaced apart along the manifold for distribution of the firefighting agent upon operation of the actuator to release the compressed gas supply and pressurize the manifold with the agent along the manifold. In an alternate embodiment, the preferred fire protection unit includes a stored volume of firefighting agent; a manifold coupled to the stored volume, the manifold defining a longitudinal axis and an internal passageway; and an actuator axially aligned along the manifold. In one embodiment the firefighting agent is stored at an operating pressure of the unit and more preferably stored in the manifold. To pressurize the firefighting agent, the fire protection unit can includes a propellant supply. For preferred embodiments of the fire protection unit described herein, the firefighting agent is preferably a dry chemical agent.

Because preferred embodiments of the fire protection unit include their own source of firefighting agent, the units can be positioned, operated individually and collectively in any manner to protect a fixed space in a desired manner. A fire protection system preferably includes a controller, at least one fire detector in communication with the controller; and a plurality of a plurality of fire units coupled to the controller. The plurality of fire protection units of preferred systems, can be connected in series and alternatively or additionally in series with one another and the controller. Preferably, the detector signals the controller at an incipient stage of a fire for operating the actuator provide an early response of the system to a fire. Preferred methods fire protection are provided in which the fire protection units are independently positioned for fire protection of a fixed space. In one preferred embodiment of fire protection of a fixed space, the method includes obtaining at least one fire protection unit including an actuator and a fixed volume of firefighting agent; and providing the at least one fire protection unit to protect the fixed space. One preferred embodiment includes providing a controller providing at least one fire detector in communication with the controller; and providing a plurality of the fire protection units coupled to the controller, each of the fire protection units including the fixed volume of firefighting agent and a manifold defining a longitudinal axis and an internal passageway, the actuator being arranged to pressurize the internal passageway of the manifold with the firefighting agent. In another preferred method, a fire protection unit is positioned so as to be shield a distribution manifold of the protection unit behind a structural member of the space. The preferred method includes pressurizing the manifold with a fixed firefighting agent supply volume and a fixed propellant supply volume to protect the fixed space.

Given the construction of the units and their flexibility in which the units can be installed, positioned and interconnected. The fire protection units can be installed and deployed to address the various design consideration that arise for system protection of fixed spaces. For system assembly expansion, it is believed that the units can be deployed to address many of the concerns or problems associated with fire protection of tunnels, equipment rooms or vehicle storage facilities as previously described. For example, because the preferred unit includes its own volume of propellant and firefighting agent, the unit can be installed in area with limited access to water. Additionally, because the unit can be positioned and its operation controlled, concerns about uncontrollably depleting the system supply of agent is minimized or eliminated. Moreover, because the preferred systems and units use controlled volumes of dispersed agent and in some embodiments a dry agent, there is no concern about collecting large volumes of water in the compartments of the stored commodities, vehicles or equipment.

The units can be individually positioned to be shielded in order to avoid impact damage from moving equipment, personnel or commodities in a given space application. Additionally, because the units can be independently positioned for desired application of the firefighting agent, the units can be positioned to protected commodities, equipment or other items of varying dimensions or non-uniform shape. This can be particularly advantageous in protecting large equipment or vehicles such as boats stored dry in rack-type bays, mining equipment or parking garages. This can minimize or eliminate the danger to personnel from storage racks overloaded with water collected in the compartments of, for example, the stored boats.

BRIEF DESCRIPTION OF DRAWINGS

The accompanying drawings, which are incorporated herein and constitute part of this specification, illustrate exemplary embodiments of the invention and, together with the general description given above and the detailed description given below, serve to explain the features of exemplary embodiments of the invention. It should be understood that the preferred embodiments are some examples of the invention as provided by the appended claims.

MODE(S) FOR CARRYING OUT THE INVENTION

Figure 1A:
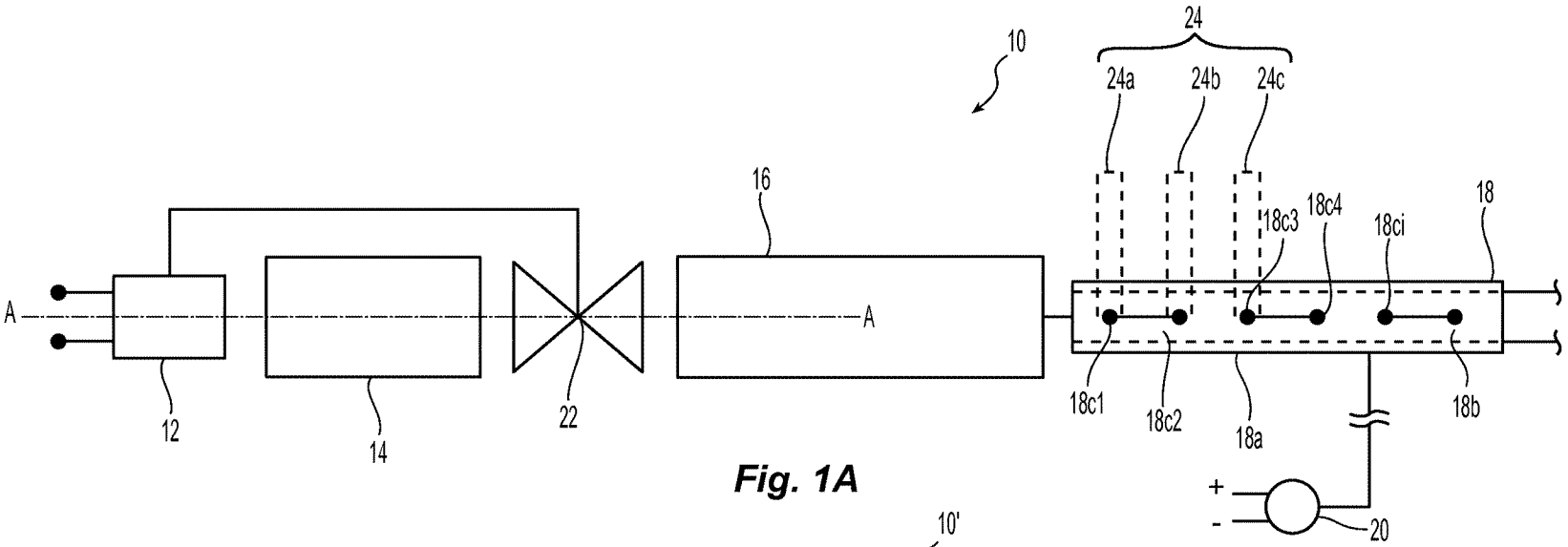
FIG. 1A is a schematic view of a preferred embodiment of a fire protection unit.

Schematically shown in FIG. 1A is a preferred embodiment of a fire protection unit 10 for independently positioning or mounting in a desired location to address a fire and provide fire protection of a fixed space. The unit 10 preferably addresses a fire by suppression but can be alternatively configured for fire control. The preferred fire protection unit 10 includes an actuator 12, a propellant source 14, a source of firefighting agent 16, and a manifold 18 for the distribution of the firefighting agent to address a fire. Accordingly, preferred embodiments of the units 10 includes its own separate, individual or discrete fixed volume supplies of propellant and agent 14, 16. The actuator 12 is coupled to the preferably fixed volume of propellant 14 to control the release of the propellant 14. The actuator 12 can control the release of the propellant by a fluid control device 22, such as for example, a control valve or rupturable disc coupled to the actuator 12 and preferably disposed between the propellant 14 and the agent 16. The propellant 14 is preferably connected or coupled to the fixed volume of firefighting agent 16 to pressurize and disperse the agent 16. The manifold 18 is coupled to and in preferably controlled fluid communication with the firefighting agent 16 for distribution and/or dispersion of the agent. The unit 10 can include, incorporate, or be coupled to or associated with a fire detector 20 for detection of a fire. Upon detection of a fire by the detector 20, the actuator 12 is signaled to operate to control release of the propellant 14 for pressurizing the manifold 18 with the firefighting agent 16. The pressurized firefighting agent 16 is dispersed or distributed by the manifold 18 to address and more preferably suppress the detected fire. Accordingly, preferred embodiments of the unit 10 are preferably modular to provide fire protection in a manner described herein.

The actuator 12 preferably includes an electronically operated actuator which can be operated by an appropriately configured control or operating signal. In a preferred embodiment, the actuator 12 can include a solenoid for translating a pin or other internal mechanism to operate the fluid control device 22. The actuator 12 can be combined with or embodied in the fluid control device 22. For example, the actuator 12 can be embodied as a Protracting Actuating Device (PAD) or an electrically operated solenoid valve. The preferred actuator 12 preferably includes a mechanical backup such that the actuator can be operated by an appropriate thermally responsive element to provide for alternate actuation or more preferably secondary actuation or back-up actuation to the primary electrical actuation. A preferred mechanical back-up would include a thermal element in combination with a mechanical block or seal that prevents the actuator 12 from operating. Upon exposure to sufficient heat and/or control signal, the thermal element would respond to release or remove the mechanical block to permit the actuator 12 to operate. Accordingly, heat from a fire can also actuate a unit 10 as a back-up response in the absence of an appropriate control signal.

Preferred embodiments of the unit 10 can be coupled or connected to a centralized power source or alternatively have its individual own power source and/or backup power supply.

Figure 1B:
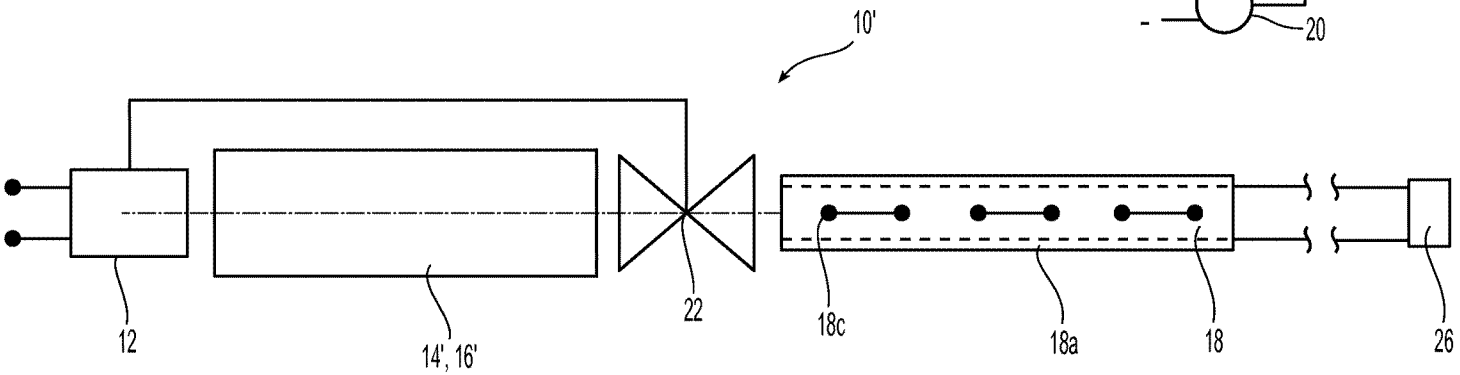
FIG. 1B is a schematic view of another preferred embodiment of a fire protection unit.

In the preferred unit 10 of FIG. 1A, the propellant 14 and firefighting agent 16 are separately housed in their own pressure vessels or storage volumes. Alternatively, the propellant and firefighting agent can be integrated into a single vessel 14', 16', as seen for example in the unit 10' of FIG. 1B, and coupled to the actuator 12 for controlled release to the manifold 18. Accordingly, the firefighting agent 16 can be stored under pressure for release at a desired operating pressure of the unit 10'. Referring again to FIG. 1A, the propellant 14 is preferably a fixed volume of a compressed gas, such as for example nitrogen, which defines a preferred internal pressure, discharge pressure and supply duration. Alternative exemplary gases for use as a propellant include, for example, carbon dioxide. Further in the alternative, the propellant 14 can include an explosive propellant having a fuel and an ignition, such as for example a wick, coupled to the actuator to create an explosion to eject the firefighting agent. The explosive propellant can provide for hybrid actuation including electronic ignition and thermal ignition of the wick, for example. The propellant 14 is coupled with the actuator 12 such that when the actuator 12 receives an appropriate operating signal, the actuator operates to release the compressed gas or other propellant for pressurizing the firefighting agent 16. The firefighting agent is preferably a fixed volume of dry powder or chemical agent, but may alternatively be embodied as a liquid agent capable of dispersion by an appropriate propellant. An example of liquid agent can be water or a more preferred wet agent such as "LVS Wet Chemical Agent" from Ansul in Marinette, Wis., shown and described in Tyco Fire Suppression & Building Products Data/Specification Form No. F-2010249 (2010). The preferred dry agent preferably includes a dry suppressant preferably providing freeze resistance, easy cleanup, minimal safety impacts, and elimination or reduction of water damage risk, etc. The alternative wet agent 16 is a wet suppressant that can be used for adherence to the products being protected. This may be particularly helpful in providing a prophylactic fire protection effect.

Figure 2A:
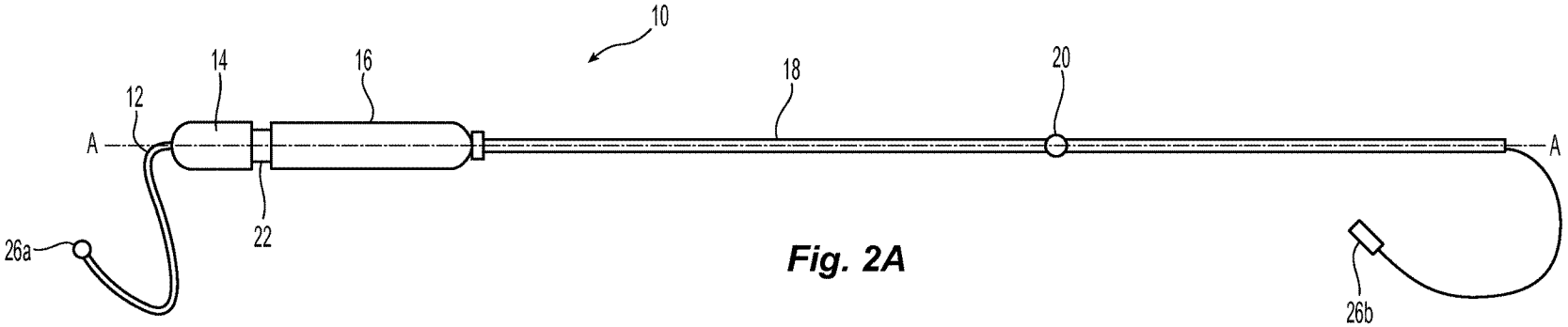
FIG. 2A is a pictorial view of a preferred fire protection unit according to FIG. 1A.

Shown in FIG. 2A is one preferred embodiment of the unit 10. The unit is preferably a fully integrated unit with its own actuator 12, propellant 14, firefighting agent 16 and manifold 18. The unit 10 is further preferably configured for portability, ease of installation and removal in a manner described herein. Accordingly, the components of the preferred unit 10 are preferably axially aligned to allow for ease in handling and installation. More specifically, the actuator 12, compressed gas supply 14, agent 16 and manifold 18 are substantially axially aligned along the longitudinal axis A-A.

The manifold 18 is coupled to the firefighting agent 16 for dispersing the agent. The preferred manifold 18 preferably includes or is formed from a tubular member 18*a* defining an internal passageway 18*b*, as seen in FIG. 1A, for axial alignment along the longitudinal axis A-A. Preferably formed along the tubular member 18*a* are a plurality of openings 18*c* (18*c*1, 18*c*2, 18*c*3, 18*c*4 . . . 18*ci*) in fluid communication with the internal passageway 18*b*. The openings 18*c* are preferably spaced apart linearly and/or angularly along and about the tubular member 18*a*. Upon operation of the actuator 12, the gas propellant 14 is released to energize the firefighting agent 16 and pressurize the internal passageway 18*b* of the manifold 18. The firefighting agent is ejected from out of the openings 18*c* for distribution. The manifold defines an axial length and cross-sectional area along the longitudinal axis such that the manifold 18 can be sufficiently pressurized by the propellant 14 or pressurized agent 16' for sufficient distribution from the openings 18*c* to address and more preferably suppress a fire.

To further facilitate distribution of the firefighting agent, the openings 18*c* define a desired discharge characteristic such as, for example, a working discharge pressure, flow, and/or discharge density sufficient to address and more preferably suppress a fire. For example referring again to FIG. 1A, each of the openings 18*c* is preferably circular at the external surface of the tubular member 18*a* having a diameter ranging from about 1/16 inch to about 1/8 inch. The openings 18*c* can define alternate geometries at the external surface of the tubular member 18*a* such as, for example, triangular, rectangular, rectilinear, or oblong provided the opening delivers the desired discharge characteristics.

To protect the manifold 18 and its internals from dust and/or debris, blow off caps or plugs can be disposed within the openings 18*c* of the manifold. Upon actuation, the operating pressure within the manifold would be sufficient to blow off the cap or plugs. Accordingly, the units are preferably sealed but more preferably do not require a fluid tight seal. In one preferred embodiment, the manifold 18 can include one or more tubes or tubular members 24 (24*a*, 24*b*, 24*c*) coupled to the plurality of openings 18*c* of the manifold 18. Alternatively or additionally, one or more nozzles and preferably mist-type nozzles can be coupled to the openings 18*c* or tubes 24 for distribution and/or atomization of the agent. The preferred embodiments of the manifold show multiple openings 18*c*, but the manifold can alternatively include or consist of a single opening 18*c* provided the single opening provides the desired discharge characteristics to effectively address and more preferably suppress a fire.

Figure 1D:
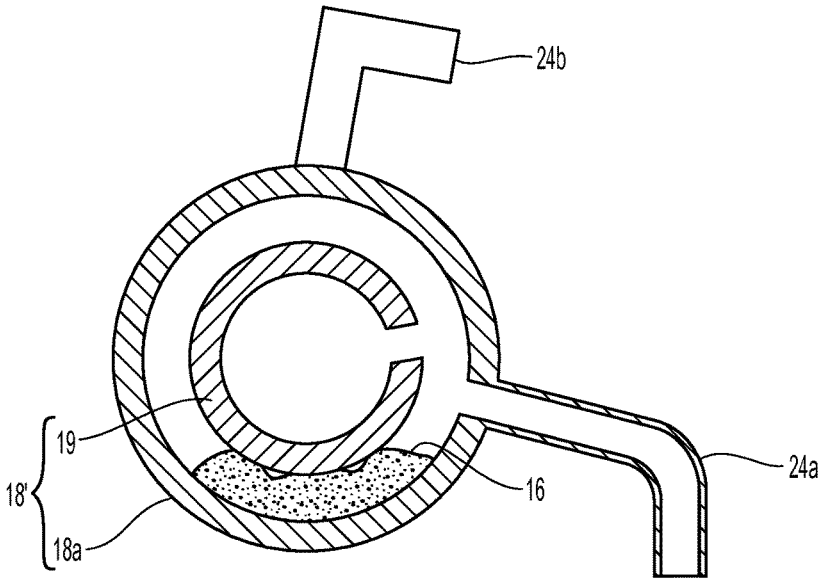
FIG. 1D is a cross-sectional view of the manifold of the unit of FIG. 1C along line ID-ID.
Figure 1C:
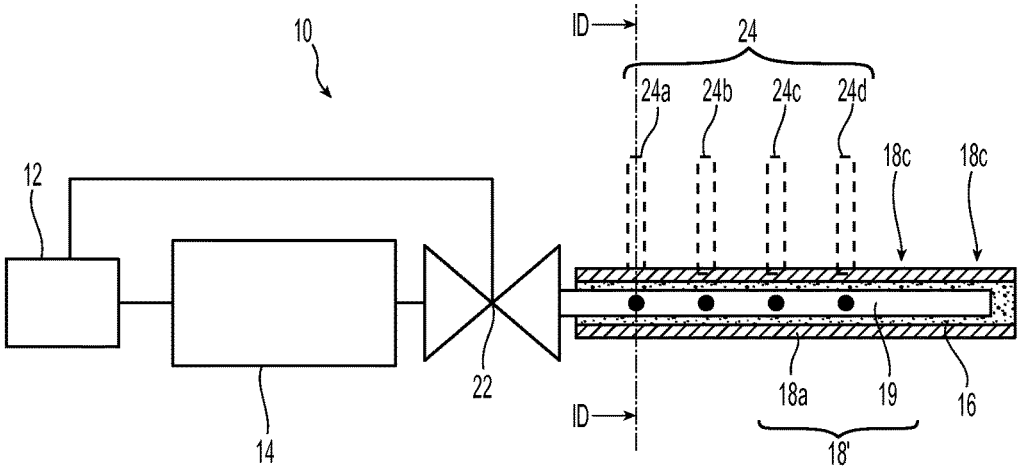
FIG. 1C is a schematic view of yet another preferred embodiment of a fire protection unit.
Figure 1E:
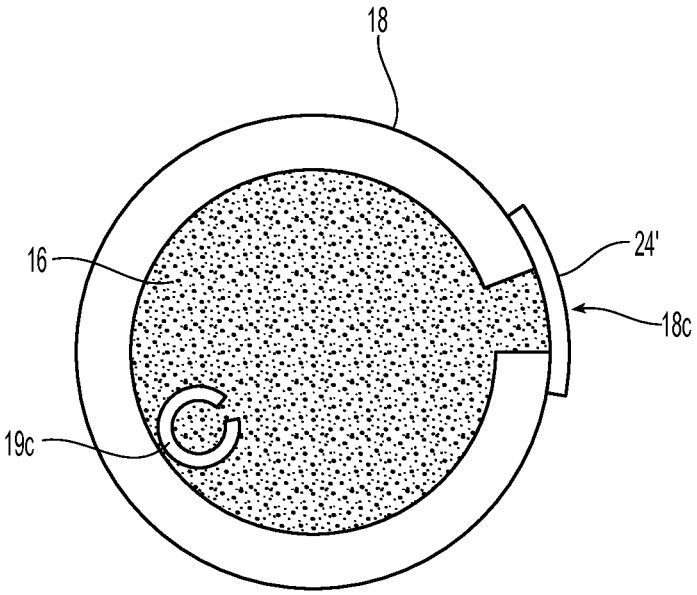
FIG. 1E is a cross-sectional schematic view of an alternate embodiment of the manifold of FIG. 1C.
Figure 2B:
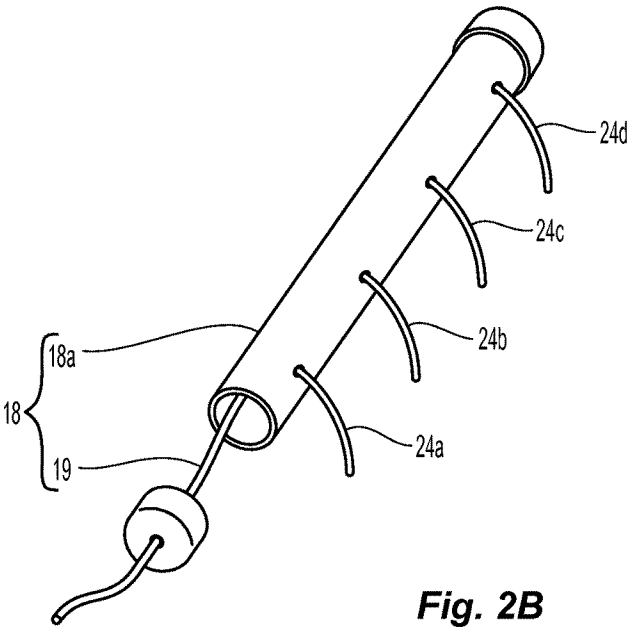
FIG. 2B is a pictorial view of a preferred manifold according to FIG. 1C.

Shown in FIGS. 1C and 1D is an alternate embodiment of the unit 10 having a manifold 18' in which the tubular member 18*a* can serve as a storage tube or volume for the firefighting agent 16. A pressurizing tube 19 preferably runs or extends internally to the tubular member 18*a* for controlled pressurization of the tubular member 18*a* upon actuation. The internal pressurizing tube 19 is coupled to the propellant 14 via the fluid control device 22 to carry the preferred pressurized gas to the tubular member 18*a*. The internal tube 19 includes one or more openings or holes for discharging the propellant within the tubular member 18*a*. The tubular member 18*a* is appropriately sealed or covered in the unactuated state of the unit 10 to permit the space between the tubular member 18*a* and the inner pressurizing tube 19 to be sufficiently pressurized to discharge and/or disperse the firefighting agent 16 to address and more preferably suppress a fire. The tubular member 18*a* can be configured in any manner as previously described provided that it can receive the pressurizing tube 19 and store the firefighting agent 16. For example, shown in FIG. 1E is an alternate embodiment of the manifold 18 with pressurizing tube 19 in which a protective blow-off shield, blow off cap or plug 24' is disposed within the openings 18*c*. An exemplary embodiment of an alternatively configured manifold 18' is shown in FIG. 2B.

The unit 10 preferably operates directly or indirectly in response to a fire detection signal. In one preferred embodiment of the unit 10, the manifold 18 includes or incorporates a fire detector 20. The fire detector 20 is preferably configured for performing a self-test in combination with the actuator 12. In an exemplary embodiment, the detector can generate a simulated or test signal to verify proper detection. For example, the detector 20 can be embodied as a heat detector with a heating element disposed adjacent to a heat sensor circuit.

An exemplary heat detector is shown and described in SIMPLEX Technical Data Sheet No. S4098-0019-12 entitled, "True ALARM® Analog Sensing." The heating element can be heated by an appropriate control circuit to activate the heat sensor circuit. Alternatively, the heat detection circuit can be directly activated by the electrical signal. Further in the alternative, the fire detector 20 can include or be embodied as an optional photo-electric or ionization detector using electronic activation of the input portion of its associated input. In another embodiment, the detector 20 is embodied as a Linear Heat Detection: LHD. The actuator 12 can be configured for direct actuation by the LHD.

Figure 3:
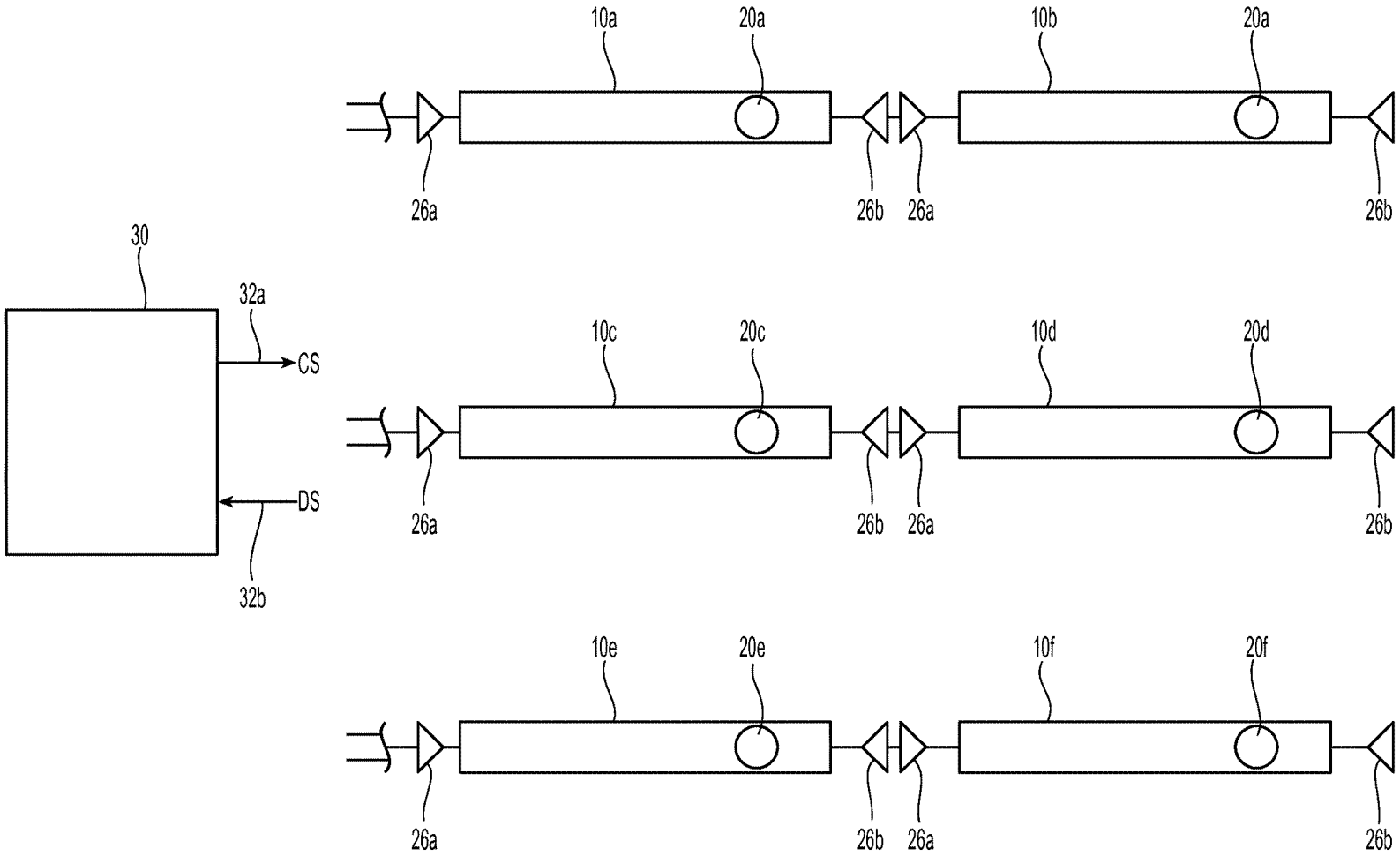
FIG. 3 is a schematic embodiment of a preferred fire protection system using the units of FIGS. 1A and 1B.

Actuation of the unit 10 can be initiated by an appropriate control signal delivered to the actuator 12. Preferred embodiments of the unit 10 and systems incorporating the unit 10 can include a centralized controller 30 for controlled operation of one or more fire protection units 10. Shown in FIG. 3 is a central controller 30 for controlling one or more units 10 (10*a*, 10*b*, 10*c*, 10*d*, 10*e*, 10*f*). The controller 30 includes an output line 32*a* for communicating an appropriate control signal CS to the one or more units 10 and further preferably includes an input line 32*b* for receipt and processing of a fire detection signal DS from the one or more fire detectors 20, shown as preferably integrated with a corresponding unit. Upon detection of a fire by one or more detectors (20*a*, 20*b*, 20*c*, 20*d*, 20*e*) the signal is sent to the central controller 30. The central controller 30 processes the detection signal to preferably identify and selectively address units 10 for operation. An exemplary embodiment of a controller 30 for use with the unit 10 is shown and described in SIMPLEX Product Data Sheet, S4100-0031-25, "4199 Fire Control Panels: Addressable Fire Detection and Control Basic Modules and Accessories" (November 2013). The preferred controller 30 provides for centralized control and operation of the units 10. The controller 30 more preferably provides for self-testing of the units in a manner as previously described. In addition, the unit 10 can monitor, preferably including a sensor in communication with the controller 30 to monitor, release of the propellant 14 to communicate any sensed signal indicating propellant release. Accordingly, the preferred controller 30 provides for supervision of the unit 10. In another preferred aspect, the centralized controller 30 provides for remote control, supervision, testing and reporting of the system and unit operation.

As shown, multiple fire protection units 10*a*, 10*c*, 10*e* can be coupled to the controller 30 in series and/or parallel. Alternatively or in addition, to expand the number of units 10 coupled to the controller 30, units 10 can be coupled to one another in series. Accordingly, preferred system installations of the units 10 can be scaled in size by the addition or removal of units to suit a desired application, location or position. As shown, each unit 10 can include a first connector and more preferably a first end connector 26*a* and a second connector and more preferably a second end connector 26*b* for joining the units in series and/or parallel to one another. The connectors 26*a*, 26*b* preferably carry appropriate signaling or communication signals unit-to-unit and through the unit 10 to its electrical components, e.g., actuator or detector. Preferred communication signals include one or more of: alarm signals, actuation signal(s), supervision signals, detection signals, propellant or agent release signals, status signals, and/or fault signals or conditions. The units and preferred connectors 26*a*, 26*b* preferably employ mineral-insulated copper-clad (MICC) cable for unit to unit interconnection to provide preferred fire resistance. So long as the fire protection units 10 are electrically interconnected to one another and the preferred controller 30, preferred system installations are provided in which the system provides fire protection of a fixed space yet each fire protection units can be individually positioned to provide the desired fire protection for the fixed space. This flexibility can present an installation advantage over systems having a central supply of firefighting agent in which the distribution devices or sprinkler devices are constrained by the fluid supply piping.

Accordingly, the preferred construction, installation and centralized selective control and operation of the units 10 can provide for preferred systems and methods of fire protection of a fixed space. Examples of such fixed spaces for fire protection include, but is not limited to, warehouses; storage occupancies, storage bays, storage compartments, or portions thereof including storage compartments or racks; land, air, or water vehicle storage facilities or portions thereof including garages, hangers, or dry dock boat rack storage facilities and/or air, land or water vehicle interiors or compartments including cargo vessels and their holding areas, boat or ship hulls, automobile interiors, aircraft cabins and any other fixed space in which the preferred fire protection units 10 can be installed in a manner described herein. The storage spaces or occupancies can provide for the storage of equipment or components including for example, batteries, commodities of varying classification, or larger stored items such as for example, vehicles and their component parts. Other fixed spaces in which the fire protection units 10 can be installed include areas with limited access or clearance with limited foot traffic, such as for example, kitchens, vents, ducts, mines, tunnels, equipment rooms or concealed spaces, attic spaces or portions thereof.

Figure 4C:
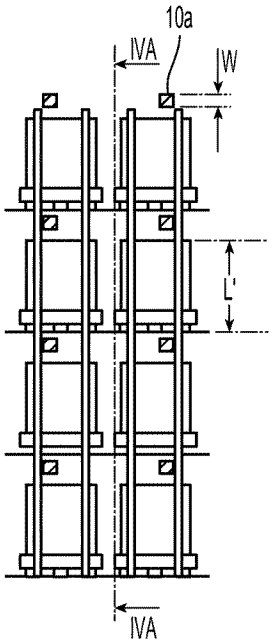
FIGS. 4A-4C are schematic views of a preferred in-rack installation of the system of FIG. 3.
Figure 4A:
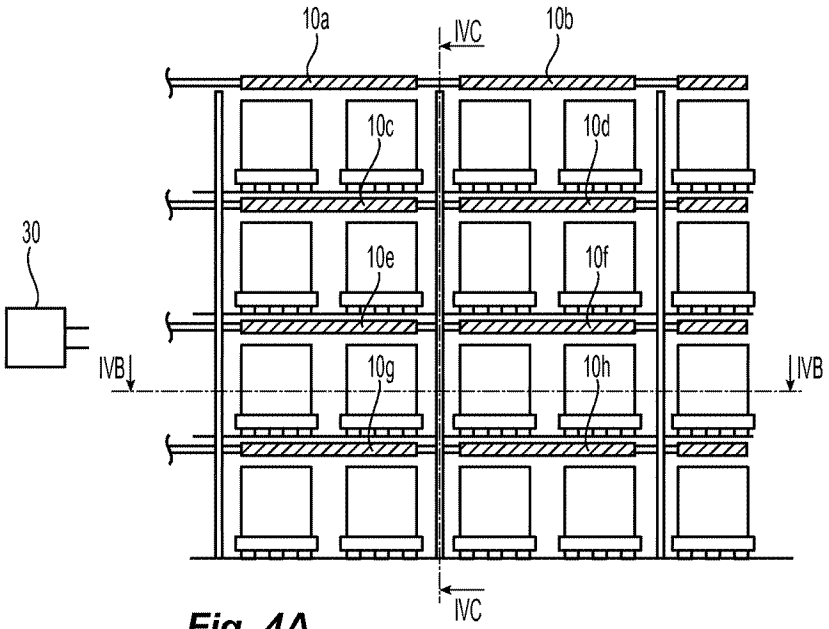
Figure 4B:
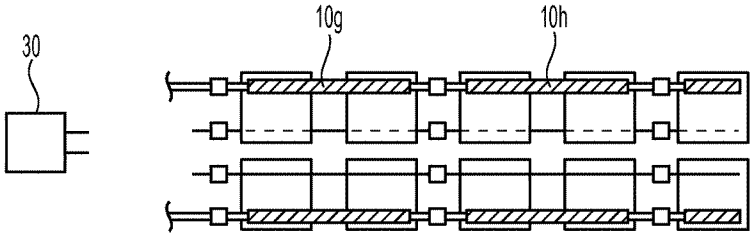

Shown in FIGS. 4A-4C is an example of a system installation for the protection of a storage bay of commodities in a rack storage configuration. The installation includes units 10 (10*a*-10*h*) installed for selective operation by the controller 30 to provide for a preferred in-rack storage arrangement of the fire protection units. The controller 30 can be configured and/or programmed to address a detected in-rack fire in a preferred manner. For example, the controller 30 can define an algorithm in which to identify and select fire protection units 10 for operation. In one preferred algorithm, the controller 30 and system are configured for early detection and suppression of a detected fire. Moreover the controller 30 is preferably programmed to activate units 10 in zones and/or bays adjacent to, and in particular over or above the storage shelf or location in the rack where the fire was detected.

Figure 5:
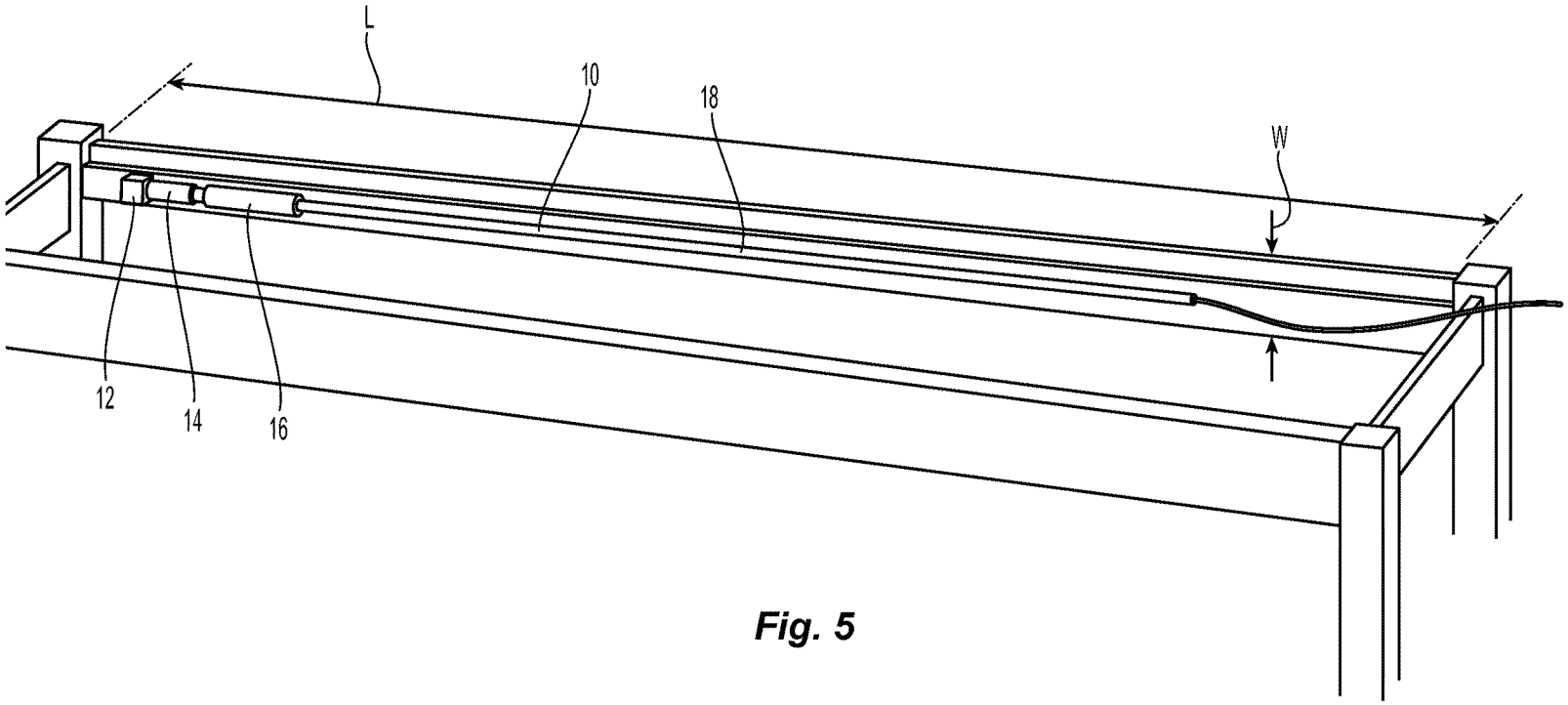
FIG. 5 is a pictorial view of a preferred in-rack installation of the fire protection unit of FIG. 2A.
Figure 6B:
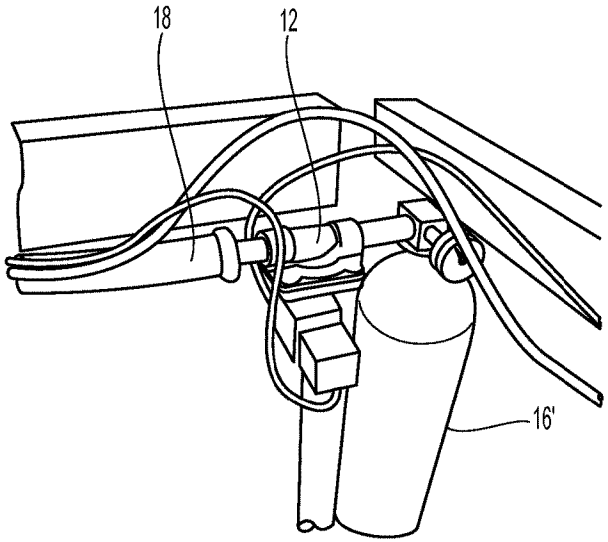
FIGS. 6A and 6B are pictorial views of a preferred in-rack installation of the fire protection unit of FIG. 1B.
Figure 6A:
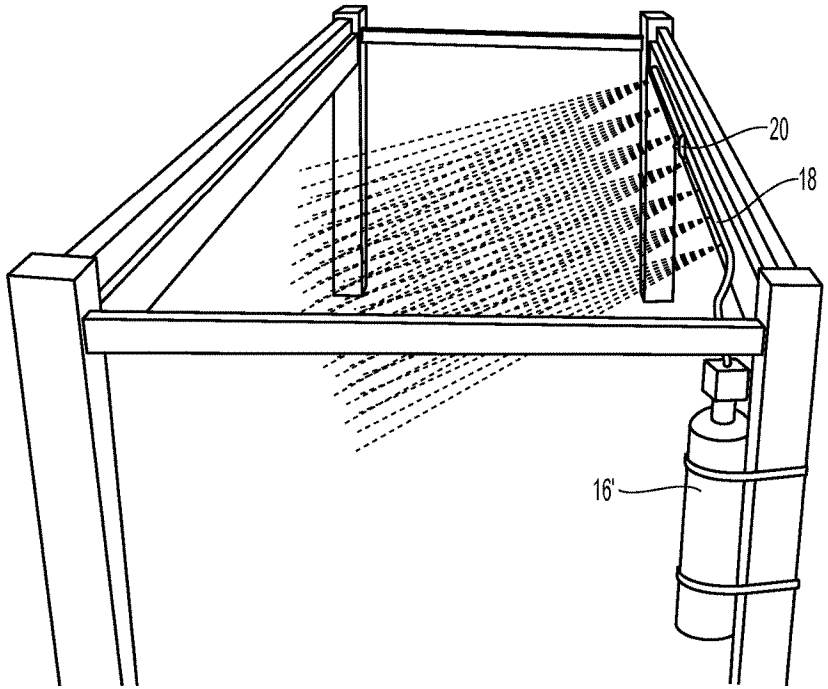

To illustrate the independent positioning of the units 10 to address the problem of impact damage from moved commodities or equipment, the fire protection units 10 are preferably mounted on the frame of the rack storage so as to be "hidden" or protected by the frame members of the storage rack. More particularly, the preferred axially aligned components of the units 10 are preferably sized for being within the footprint or shadow of the surface area defined by the frame members, while being sufficiently sized to provide effective fire protection, and more preferably fire suppression. Accordingly, where the horizontal members define a length L and a width W as shown in FIGS. 4A-4C, the units 10 define a length and maximum width to preferably fit within the boundary defined by the length L and width W of the horizontal member. Shown in FIG. 5 is a preferred in-rack installation of the preferred unit 10 shown in FIG. 2A along a horizontal member. Alternatively, one or more of the components of the units 10 can be sized to fit within the footprint or shadow of the length L' and width W' of the vertical members of the rack storage. Shown in FIGS. 6A and 6B is a preferred in-rack installation of the preferred unit 10 shown in FIG. 1B in which the manifold 18 is mounted to the horizontal member of the rack and the agent 16 is mounted to a vertical member. By mounting the units 10 to the framework of the rack storage, the racks can be pre-wired for interconnection with the preferred connectors 26*a*, 26*b* of the units 10. This can facilitate easy installation and change out of the units 10 at a reduced labor and/or material cost. Moreover, pre-wiring allows for modular installation and change out of units 10 with their preferably discrete actuators and firefighting agent supplies, which can provide for flexibility to easily change or alter storage arrangements and/or alter or expand the fire protection system. Furthermore, by facilitating easy change out and/or addition of units 10, complete system shutdown can be avoided or greatly minimized.

Regardless of the particular orientation of the unit components 16, 18, the units are preferably sized for the protection of the volume or the compartment of the rack storage being protected by the unit 10. For example, where the members of one compartment of the rack storage define fixed space, the volume of agent and propellant are sized for delivery of an appropriate density such, as for example, part of agent per cubic foot to provided sufficient protection to the fixe space. Accordingly, the units 10 and their individual components, e.g. propellant 14 or firefighting agent 16, are preferably scalable to facilitate the installation and fire protection objectives described herein. In a preferred embodiment and installation of in-rack storage protection, a unit 10 can preferably provide for suppression fire protection of at least one bay of rack storage, preferably at least two rows of rack storage and even more preferably at least one row of rack storage.

More generally, the units 10 can be interconnected in series and/or in parallel to provide a fire protection system for any fixed space or any desired storage or equipment configuration defined by the space in which the storage, equipment or other items are to be located. For example, the units 10 can be interconnected to build a fire protection system at any desired storage, ceiling or occupancy height. For example, the units 10 can be interconnected and installed to provide preferred storage fire protection for heights for up to 110 feet or greater. Because the preferred units 10 can provide for controlled application of firefighting agent, fire protection can be provided, for example, at storage-to-ceiling clearance distances ranging from 0 feet to 15 feet or even greater. The preferred firefighting agent 16 of the system 10 can address a variety of hazards and more preferably provide for fire protection of expanded plastic hazards. Additionally or alternatively, the fire protection units 10 can be spaced and positioned to provide fire protection for equipment or items that are not uniformly shaped. Accordingly for example, systems can be configured for the protection of vehicles or equipment of varying sizes and/or shapes.

Preferred methods of fire protection can include obtaining, procuring or assembling a preferred fire protection unit 10 including an actuator 12 and a fixed volume of firefighting agent 16; and providing the at least one fire protection unit to protect the fixed space. One preferred method includes providing a controller 30 providing at least one fire detector 20 in communication with the controller; and providing a plurality of the fire protection units 10 coupled to the controller, each of the fire protection units including the fixed volume of firefighting agent and a manifold defining a longitudinal axis and an internal passageway, the actuator being arranged to pressurize the internal passageway of the manifold with the firefighting agent.

Given the flexibility in which the units 10 can be installed, scaled and interconnected for system expansion, it is believed that the units 10 can be deployed to address many of the concerns or problems associated with fire protection of tunnels, equipment rooms or vehicle storage facilities as previously described. For example, because the unit 10 includes its own volume propellant and firefighting agent, the unit can be installed in area with limited access to water or other firefighting fluid source. Additionally, because the unit 10 can be mounted and its operation controlled, concerns about uncontrollably depleting the system supply of agent 16 is minimized or eliminated. When configured with a thermally responsive mechanical actuator 12, the unit 10 can also be used in areas with limited access to electrical power.

As described above, the units 10 can be mounted and "hidden" to avoid impact damage from moving equipment and commodities. Additionally, because the units 10 can be flexibly mounted for desired application of the agent 16, the units can be positioned to protected commodities, equipment or other items of varying dimensions or non-uniform shape. This can be particularly advantageous in protecting large equipment or vehicles such as boats stored dry in rack-type bays, mining equipment or parking garages. Moreover, because the preferred systems and units preferably use controlled volumes of dispersed agent 16 and in some embodiments a dry agent, there is no concern about collecting water in the compartments of the stored commodities, vehicles or equipment. This can minimize or eliminate the danger to personnel from storage racks overloaded with water collected in the compartments of, for example, the stored boats.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A fire protection unit comprising:

an actuator;

a fire detector to signal operation of the actuator;

a fixed volume supply of compressed gas defining an internal pressure and supply duration, the supply being coupled to the actuator for controlled release of the compressed gas;

a fixed volume source of firefighting agent coupled to the fixed volume supply of compressed gas; and a manifold coupled to and downstream of the fixed volume source of firefighting agent for dispersing the firefighting agent, the manifold defining a linear longitudinal axis downstream of the fixed volume source of firefighting agent, an internal passageway and a plurality of openings in fluid communication with the internal passageway and spaced apart along the manifold for distribution of the firefighting agent upon the operation of the actuator to release the compressed gas supply and pressurize the manifold with the agent along the internal passageway of the manifold, the actuator axially aligned with the manifold along the longitudinal axis, the fixed volume supply of compressed gas and the fixed volume source of firefighting agent axially aligned with the manifold along the longitudinal axis.

2. The unit of claim 1, wherein the firefighting agent comprises one of water, a liquid agent, or a dry chemical agent.

3. The unit of claim 1, wherein the actuator includes an electronically operated actuator and a mechanical backup.

4. The unit of claim 1, further comprising at least one connector for electrically interconnecting the fire protection unit to one of a controller, a detector or another fire protection unit.

5. The unit of claim 1, further comprising a plurality of tubes, each tube coupled to one of the plurality of openings of the manifold.

6. The unit of claim 1, wherein the fire protection unit is installed for fire protection of in-rack storage.

7. A fire protection system for a fixed space, the system comprising:

a controller;

at least one fire detector in communication with the controller; and at least one fire protection unit independently positioned to protect the space, the at least one unit including:

an actuator coupled to the controller, the controller signals operation of the actuator based on a detection signal from the at least one fire detector;

a fixed volume supply of compressed gas defining an internal pressure and supply duration, the supply being coupled to the actuator for controlled release of the compressed gas;

a fixed volume source of firefighting agent coupled to the fixed volume supply of compressed gas; and a manifold coupled to and downstream of the fixed volume source of firefighting agent for dispersing the firefighting agent, the manifold defining a linear longitudinal axis downstream of the fixed volume source of firefighting agent, an internal passageway and a plurality of openings in fluid communication with the internal passageway and spaced apart along the manifold for distribution of the firefighting agent upon the operation of the actuator to release the compressed gas supply and pressurize the manifold with the agent along the manifold, the actuator axially aligned with the manifold along the longitudinal axis, the fixed volume supply of compressed gas and the fixed volume source of firefighting agent axially aligned with the manifold along the longitudinal axis.

8. The system of claim 7, wherein the fixed space is defined by a structural frame member having a length and a width defining the boundary of the frame member, the at least one fire protection unit being disposed within the boundary defined by the length and the width.

9. The system of claim 7, wherein the fixed space is a bay of rack storage, the at least one fire protection unit includes a plurality of fire protection units protecting at least one of: one bay, two rows or single row of rack storage.

10. The system of claim 9, wherein the system provides for fire protection of storage up to a height up to at least 110 feet.

11. The system of claim 7, wherein the at least one fire protection unit includes a plurality of fire protection units, the plurality of fire protection units being interconnected with one another and the controller.

12. The system of claim 7, wherein the at least one fire detector signals the controller at an incipient stage of a fire, the controller operating the actuator in response to define an early response of the system to a fire.

13. The system of claim 7, wherein the controller provides for remote monitoring of the system.

14. The system of claim 7, wherein the fixed space is a storage occupancy storage space for vehicles, a storage occupancy or a concealed space.

* * * * *